United States Patent [19]

Hirt

[11] 4,009,985

[45] Mar. 1, 1977

[54] METHOD AND APPARATUS FOR ABATEMENT OF GASOLINE VAPOR EMISSIONS

[75] Inventor: John H. Hirt, Monterey Park, Calif.

[73] Assignee: Hirt Combustion Engineers, Montebello, Calif.

[22] Filed: Aug. 8, 1975

[21] Appl. No.: 603,002

[52] U.S. Cl. ..... 431/5; 23/277 C; 220/85 VR; 431/202

[51] Int. Cl.[2] ..... F23G 7/06

[58] Field of Search ..... 431/5, 202, 278, 284, 431/285; 220/85 VR, 85 VS; 23/277 C

[56] References Cited

UNITED STATES PATENTS

| | | | |
|---|---|---|---|
| 3,817,687 | 6/1974 | Cavallero et al. | 431/202 |
| 3,837,785 | 9/1974 | Evans et al. | 431/5 |
| 3,887,324 | 6/1975 | Reed et al. | 431/5 |
| 3,897,193 | 7/1975 | Kattan et al. | 431/5 |
| 3,902,874 | 9/1975 | McAndrew | 220/85 VR |
| 3,914,095 | 10/1975 | Straitz | 431/202 |

*Primary Examiner*—Edward G. Favors
*Attorney, Agent, or Firm*—Poms, Smith, Lande & Glenny

[57] ABSTRACT

A method and apparatus for abatement of excess gasoline vapor emissions which occur during transfer of service station liquid gasoline from one storage tank to another storage tank, such as the transfer of gasoline at a gasoline service station from a gasoline storage tank truck to underground gasoline storage tanks and also from underground gasoline storage tanks to an automobile or vehicle storage tank through a gasoline pump station. Vent outlet pipes of the underground storage tanks are manifolded to a common vent pipe, where the vapor pressure is sensed and upon reaching a predetermined vapor pressure, (normally slightly below atmospheric) vapors are directed along a path from the vent pipe to a burner means. Gasoline vapors are directed to the burner by means of suction produced by an ejector using compressed air and an air-fume mixer so that substantially complete combustion of the resulting vapor air mixture will occur in the burner means. The burner is automatically ignited and burns the vapor-air mixture whenever preselected vapor pressure conditions occur in the common vent pipe during transfer of liquid gasoline between such tanks. An apparatus including pressure-vacuum valves, a fume-fresh air mixer, and solenoid actuated valves so arranged and interconnected that a burner associated therewith will receive a combustible mixture of air and gasoline vapor and burn such vapor mixture to destroy hydrocarbon emissions in the vapor-air mixture.

19 Claims, 3 Drawing Figures

METHOD AND APPARATUS FOR ABATEMENT OF GASOLINE VAPOR EMISSIONS

BACKGROUND OF INVENTION

Air pollution by petroleum products is one of the most urgent problems of our present society. Freedom of travel in daily activities is directly affected by the availability of gasoline for motor vehicles. For example, approximately 2.2 billion gallons per year of motor vehicle gasoline are consumed within the San Francisco Bay area air pollution control district. Marketing of such gasoline involves the transfer of gasoline from one container to another, as for example, from a refinery storage tank to a bulk handling motor vehicle tank truck, thence from the tank truck to an underground storage tank at a service station, and thence from the underground storage tank to an automobile gasoline tank. The transfer of liquid gasoline from one container to another container produces gasoline rich vapors which are displaced into the atmosphere as the container is filled. In the Bay Area district it is estimated that 75 tons per day of gasoline enter the district area atmosphere.

Air pollution in the form of haze and smog formation includes breakdown of hydrocarbons of a type found in gasoline vapor. Gasoline marketing operations involving transfer of gasoline from one container to another container require careful consideration if improvements in air quality are to be achieved.

The present invention is primarily concerned with, but not limited to, reducing gasoline vapor losses at a service station area which arise during the transfer of gasoline from a bulk tank truck to an underground storage tank and thence from the underground storage tank through the gasoline pumps to an automobile tank. Gasoline vapor losses at the service station principally arise from the underground storage tank which is subjected to both breathing and displacement losses. Breathing losses are caused by alternate expansion and contraction of the tank contents due to day-night temperature differentials. Such temperature differentials are minimized by using buried tanks at gasoline storage stations. Displacement losses occur upon refilling a partially empty or empty storage tank which normally expels an equivalent volume of vapor into the atmosphere through the vent pipe of the storage tank. While there may be spilling losses in the area of the service station, such losses are relatively insignificant compared to the losses caused by breathing and displacement.

While it is readily understandable that gasoline vapor emissions may be produced by breathing and displacement conditions at a storage tank, a solution to the vapor emission control problem requires attention to boiling range of gasoline being handled. Boiling range establishes the volatility that the gasoline liquid must have in order to be effectively utilized in an internal combustion engine. In a refinery operation, crude oil is processed and its components so blended and ultimately pressurized that the finished gasoline product has a final desired vapor pressure designated "Reid Vapor Pressure" or RVP. In addition, the finished gasoline product comprises components, the heaviest of which, will readily vaporize in the gasoline engine.

For example, gasoline having a RVP of about 7.5 at 60° F. will produce vapors having about a 50/50 mixture of hydrocarbon and air. If such vapors are continuously replaced with fresh air it is possible to vaporize a very large amount of liquid gasoline. In an automobile fuel tank, air replaces the volume of fuel consumed during driving. This tank air volume will be the sole source of air to replace liquid and vapors in the preceding storage container from which liquid gasoline was drawn to fill the automobile tank, that is, the storage tank at the gas station. At the service station, vapors from the automobile fuel tank could ultimately be transferred through the storage tank to the emptied gasoline truck for return to the refinery depot.

It should also be noted that if an automobile tank is refueled directly from a delivery truck tank which is normally vapor tight, the delivery tank will obtain its displacement vapor only from the vapor space of the automobile tank as the fuel is dispensed. Thus, from the automobile tank to the delivery tank, liquid is being exchanged for gasoline saturated vapor volume. If the two tanks are at the same temperature, then the exchange of volume will be on a one to one basis. But if the delivery tank temperature is higher and colder tank displaced vapors come to equilibrium temperature, then all of the vapor from the automobile tank will not fit, in expanded condition, into the delivery tank and excess vapor will escape into the atmosphere as a vapor loss. If the delivery tank is cooler, then the vapors transferred to the delivery tank will contract and outside air must be sucked into the vent line of the delivery tank, or gas vaporized or the tank pressure remains below atmospheric pressure to make up the difference in volume.

Prior to vapor control systems and where an automobile fuel tank had only one or two gallons of gasoline remaining, this small amount of gasoline was considered to be highly "weathered" because of engine heat, high agitation and vehicle tank ventilation. By weathered is meant that the gasoline has lost some of its more volatile components. Vapor space in the automobile tank is saturated with respect to volatile components and their mole fractions in the liquid and vapors. When the automobile tank is filled with fresh gasoline more gasoline vapors are produced as gasoline is used reflecting the changed composition of the fresh gasoline. Volume of vapors discharged from the vehicle tank during refueling may be from 2 to 15 percent greater than the liquid volume of the gasoline dispensed. Various prior proposed systems have been used to cope with this problem including vapor balanced transfer systems where liquid and vapor spaces are connected together between the two containers in which liquid is to be transferred, absorption with lean oil, high pressure compression systems, adsorption of hydrocarbon vapors on activated charcoal, refrigeration of saturated vent gas, compression and refrigeration of the vent gases, and combustion devices to dispose of residual hydrocarbons in vented gases. Extremely elaborate vapor recovery systems for service station installations do not appear to be economically justified because of the small net volume of hydrocarbons to be recovered.

The present invention is directed toward a system in which the vented gases are burned and combustion efficiency is maintained even though there is a wide range in the variable characteristics of the vented gases.

SUMMARY OF THE INVENTION

The present invention contemplates a method and apparatus for abatement of gasoline vapor emissions at a service station or any location where liquid gasoline is transferred from one container to another container. The invention particularly contemplates the control and abatement of gasoline vapors which may be emitted when liquid gasoline is transferred from a gasoline delivery tank truck to an underground storage tank and then to an automobile tank.

The primary object of the present invention is to control and prevent the emission to atmosphere of significant amounts of gasoline vapors at gasoline service stations.

An object of the invention is to disclose a method and apparatus for controlling gasoline vapor emissions under usual varying ambient conditions of pressure and temperature changes as well as varying vapor pressure and temperature of gasoline delivered and transferred.

Another object of the present invention is to disclose a method and apparatus for control and abatement of gasoline vapor emissions at a gasoline service station when transfer of liquid gasoline is made to an automobile tank.

Another object of the invention is to disclose a method and apparatus for control and abatement of gasoline vapor emissions when liquid gasoline is transferred from a delivery tank truck to the underground storage tank at the station.

Another object of the invention is to provide a method and apparatus for abatement of gasoline vapor emissions at a service station wherein gasoline vapors from supply tanks, such as on a vehicle, are directed through a gasoline storage tank before being vented.

A further object of the invention is to disclose a method and apparatus for control and abatement of gasoline vapor emissions wherein generally below atmospheric vapor pressure is sensed at a vent pipe extending from the underground storage tank, and upon sensing rising vapor pressure in preselected ranges, excess vapor in the vent pipe is directed to an incinerator means and completely burned instead of being exhausted to atmosphere.

A still further object of the present invention is to disclose and provide a method and apparatus for control and abatement of gasoline vapor emissions at a service station wherein sensing vapor pressure at the vent pipe of the underground storage tank in preselected pressure ranges causes the excess vapor to be directed along one or more paths to an incinerator for burning and at the same time supplying a predetermined amount of combustion air to the incinerator so that complete practical combustion of the excess vapors will be achieved.

A more particular object of the invention is to disclose a method of abating gas vapor emissions at a gas service station wherein vapor pressure in a vent outlet pipe is sensed for directing vapors along one or more paths from said vent pipe to an incinerator means, supplying combustion air to the incinerator means in a quantity to provide substantially complete combustion of the vapor-air mixture, and igniting and burning said mixture at the incinerator means.

Another specific object of the invention is to disclose and provide an apparatus for the control and abatement of gasoline vapor emissions from a vent pipe wherein valve means are provided in said vent pipe for measuring vapor gas pressure and vacuum, means are provided for placing a burner means in communication with the vent pipe under preselected pressure conditions of gasoline vapor at the vent pipe; and means are provided at the incinerator means for igniting the burner means.

A further object of the invention is to provide a gasoline vapor emission abatement system which includes a vapor-tight closed arrangement wherein pressure of gasoline vapors in the system is sensed and excess vapors are directed from a storage tank through a vent pipe to an incinerator for burning.

A still further object of the invention is to provide a vapor emission abatement system which is economical to operate and maintain and which will comply with governmental regulations relating to emission of gasoline vapors from a service station. Further objects and advantages of the present invention will be readily apparent from the following description of the drawings in which an exemplary embodiment of the invention is shown.

IN THE DRAWINGS

FIG. 1 is a schematic view of a gasoline service station illustrating transfer paths of liquid gasoline and gasoline vapors between a delivery tank truck and an underground storage tank, and between the storage tank and the automobile tank, and the path of gasoline vapors through an underground storage tank to a vent pipe to an incinerator means to burn excess vented gas vapors under preselected conditions.

Figure 1:
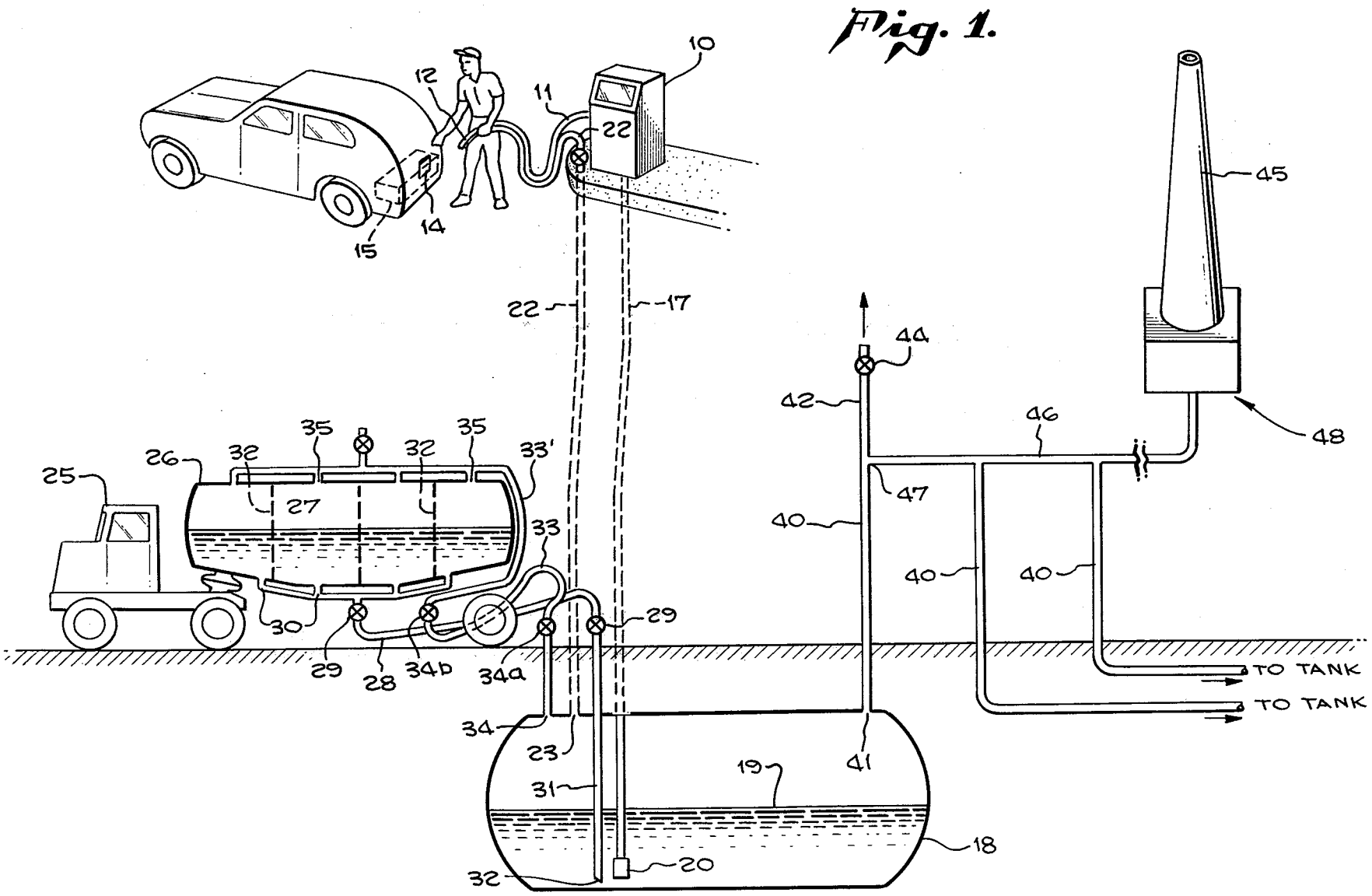

In FIG. 1 there is schematically illustrated gasoline station facilities for storage and dispensing of liquid gasoline and also for control and abatement of gasoline vapors in which excess vapors usually emitted to atmosphere at a service station are substantially eliminated. Generally speaking, a gasoline pump 10 is provided with a dispensing hose 11 having a nozzle 12 for insertion into a fill pipe 14 of an automobile gasoline tank 15. Gasoline pump 10 is connected by a gasoline line 17 to an underground liquid gasoline storage tank 18 which is shown as being partially filled with liquid gasoline at a level indicated at 19. The space above the liquid gasoline level 19 contains air and gasoline vapors and the volume of the space changes as liquid gasoline enters or is withdrawn from tank 18. Also connecting the storage tank 18 with the pump island is a gas vapor line 22 having an opening 23 at the top of tank 18 and in communication with gasoline vapors above the liquid level in tank 18. Vapor line 22 lies alongside dispensing hose 11 and at dispensing nozzle 12 may enter and communicate with fill pipe 14 and automobile gasoline supply tank 15.

Means for preventing excess gasoline vapors from being discharged into atmosphere at the automobile tank includes a seal means (not shown) which is effective to provide a vapor tight connection between fill pipe 14 and nozzle 12 which has a suitable check valve. Vapor line 22 provides a closed path sealed at the fill pipe 14 for communication of gas vapors between the spaces above the liquid levels in automobile supply tank 15 and underground storage tank 18. There is thus provided a closed vapor tight circulation system for liquid gasoline from storage tank 18 to automobile tank 15 and a vent system for communication and passage of vapors between vapor space above the level of the gasoline in automobile tank 15 and above the liquid level 19 in the storage tank 18.

FIG. 1 also illustrates a similar closed and vapor tight sealed gasoline liquid and vapor circulation system between underground storage tank 18 and a gasoline delivery truck 25 having a truck tank 26 in which the level of gasoline is generally indicated at 27. The delivery tank 26 is connected by a fill hose 28 to underground tank 18. Hose 28 has suitable manifold connections at 30 with compartments 32 defined by partition walls or bulwarks provided in the delivery tank 26. The ends of fill hose 28 are connected to suitable valves 29 at the manifold and at tank fill pipe 31 which has a bottom end 32 located close to the bottom of storage tank 18 for submerged filling. Sealed valve connections are provided to avoid loss of liquid or loss of gasoline vapors at ends of hose 28. Flow of liquid gasoline from tank 26 to storage tank 18 is normally by gravity drop when the valves are opened.

Delivery tank 26 is also connected to a bulk gasoline vapor line 33 which has an inlet opening 34 at the top of tank 18 and which includes a suitable check or block valve 34*a*. Line 33 also has a connection to a truck vapor line 33' through suitable valve 34*b*. Vapor line 33' has a plurality of connecting openings 35 each communicating with one of the compartments of delivery tank 26. Thus between delivery tank 26 and the underground storage tank 18 there is provided a closed vapor tight liquid and vapor communication system for transfer of liquid gasoline and passage of gasoline vapors from the delivery tank 26 to the storage tank 18. Preferably vapor lines 22 and 23 enter storage tank 18 adjacent one end of the tank.

Transfer of gasoline liquids and vapors under the two situations described above, that is storage tank to automobile supply tank and delivery tank truck to storage tank occurs under a closed vapor tight sealed system which prevents loss of gasoline vapors to atmosphere. However, the system must be safely operable under many different conditions of temperature, pressure and volumes of liquid gasoline and gasoline vapors which affect release of gasoline vapors from the closed system. For this purpose, storage tank 18 is provided with a tank vapor vent pipe 40 which has a vent opening 41 at the top of tank 18 preferably at the end of the tank opposite the entry of vent line 22, 33. At the top of vent pipe 40 is an outlet opening 42 for release of vapors to atmosphere under certain extreme conditions wherein some gasoline vapors may be vented. A pressure-vacuum and blow-off relief valve 44 may be provided at opening 42, valve 44 being operable at −4.6 inches WC and +5.7 inches pressure and blow-off pressure at +12 inches WC.

It will be understood that while only one underground storage tank has been shown in FIG. 1, a gasoline service station may have three or more tanks each for a different type of gasoline. The fill and outlet pipes for each tank may be arranged as described for tank 18. The vent pipes for each tank are joined at a vent header pipe 46.

The present invention contemplates means for control and abatement of vapor emissions from a gasoline service station equipped as described above wherein excess gasoline vapor emissions at vent pipes of one or more underground storage tanks are controlled and abated by directing such vent gases under certain pressure conditions, to an incinerator means where substantially complete combustion of the hydrocarbons in the vent gases occurs. The control and abatement means in this example is arranged to operate in two vent gas pressure disposal stages normally encountered at a service station, that is, where disposal pressures may be relatively low, 0 inches to −0.5 inches WC as from a delivery tank truck to the underground storage tank and when disposal pressures are relatively high, −0.5 inches WC or above, as during the dispensing of relatively small quantities of liquid gasoline to an automobile tank through the gasoline service station pumps. The two disposal pressure stages may involve the handling of liquid gasoline and vapors at different pressures, temperatures, and volumes. The vented gasoline vapors of each stage require preset amounts of air in order to achieve complete combustion of that preset amount of vented gases and the reduction to a minimum of unwanted hydrocarbon type air pollutants.

Figure 2:
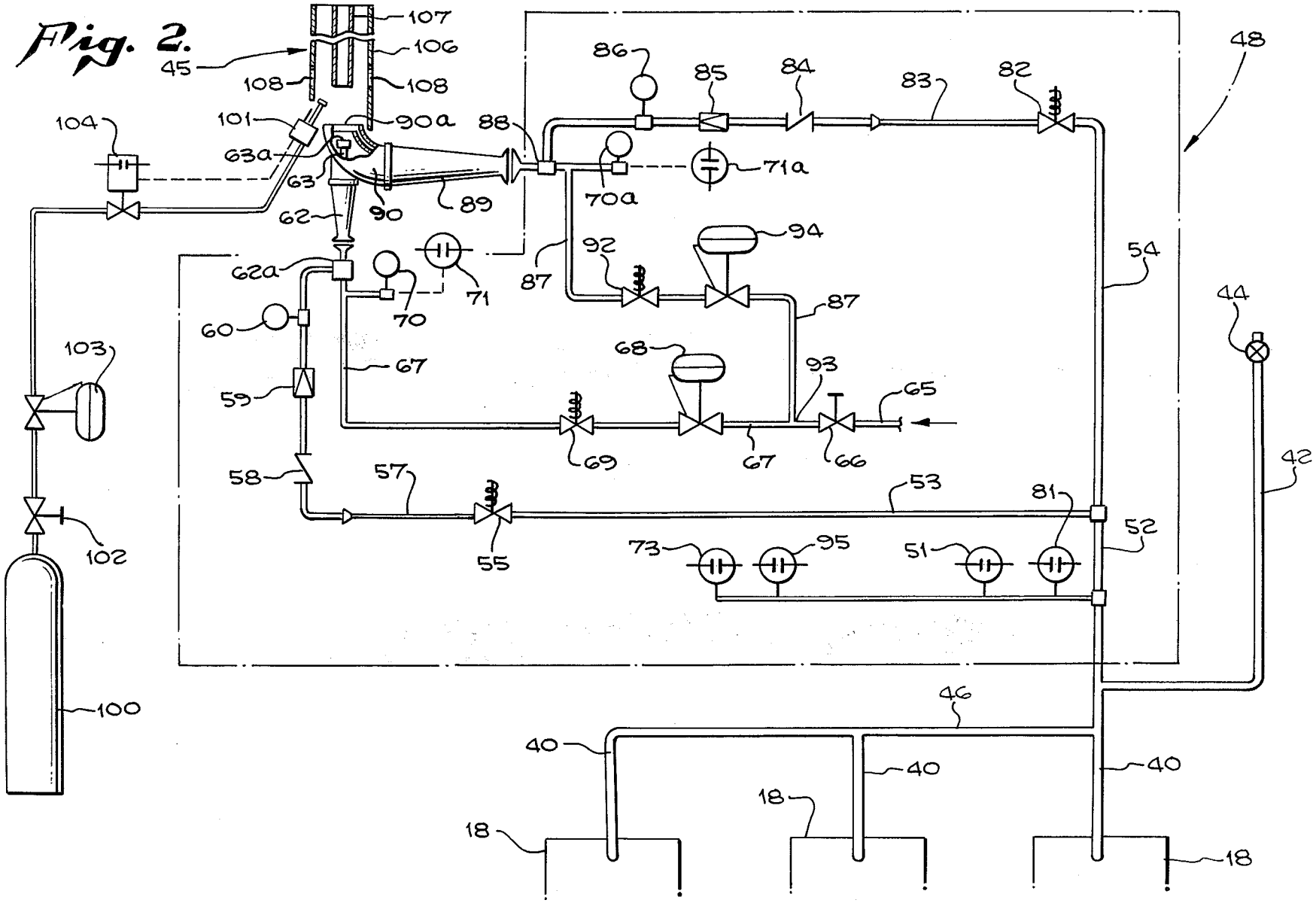
FIG. 2 is a schematic piping arrangement illustrating control of vent gas vapors from the underground storage tank.
Figure 3:
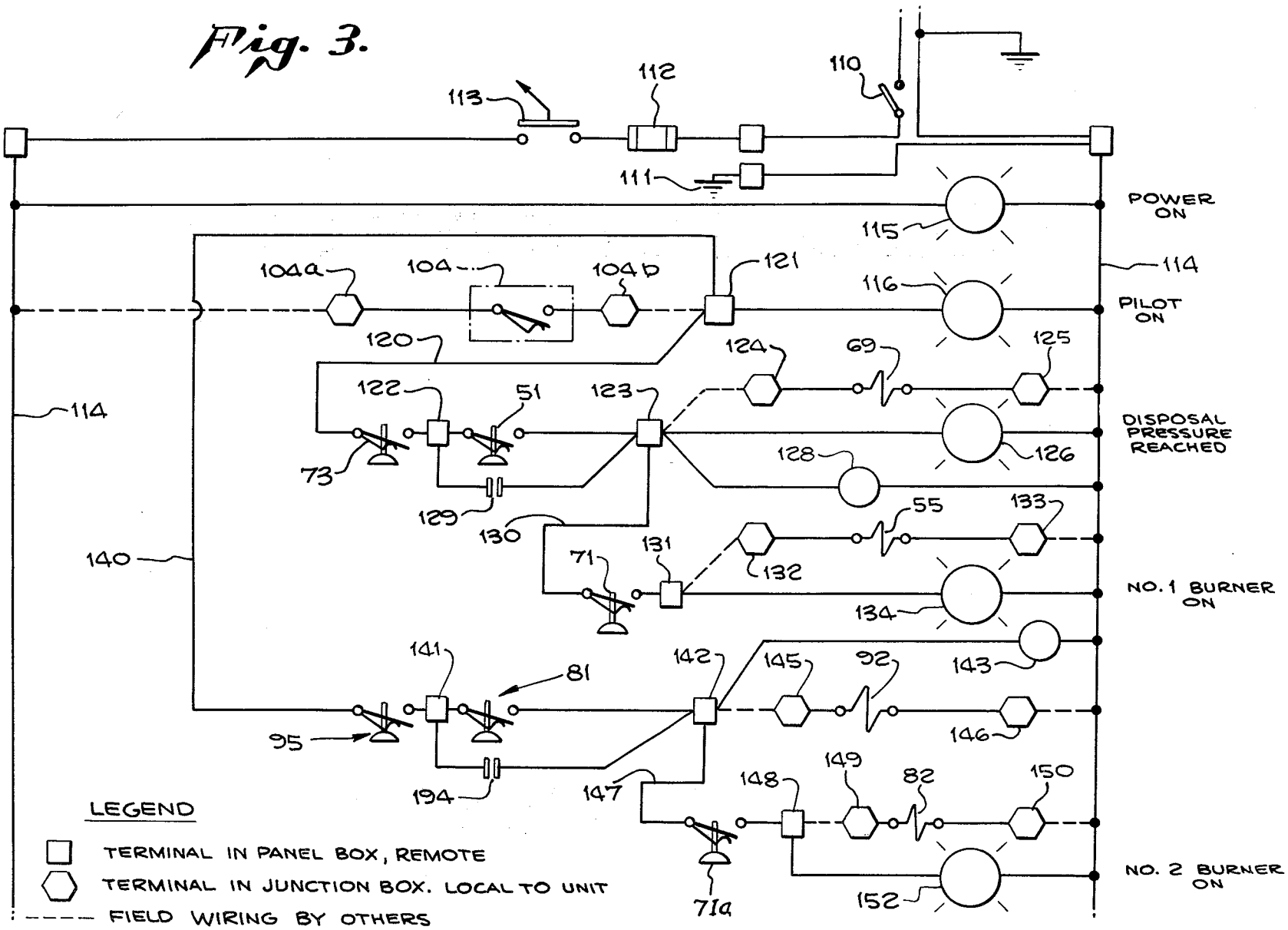
FIG. 3 is a schematic electrical diagram used in the control system shown in FIG. 2.

In this example, the two-stage control and abatement means of this invention includes a pressure-volume and blow-off relief valve 44 in tank vent pipe 40 and the transfer of vent gases from the storage tank 18 to a combustion or fume incinerator device generally indicated at 45. Vent header line 46 is connected at 47 to vent pipe 40 between tanks 18 and valve 44. Depending upon the selected pressures for actuation of pressure switches 73, 95, 51 and 81 (FIG. 2), vent gases will be transferred through vent header line 46 to a gasoline vapor-air mixing system generally indicated at 48 (FIG. 1) and which is shown in detail as to piping and electrical systems as shown in FIGS. 2 and 3 respectively. The vapor-air system 48 and incinerator device 45 are designed and arranged to provide proper vapor-air mixtures to incinerator device 45 so that device 45 will destroy at least 90 percent and as much as 99.9 percent of the hydrocarbons supplied to it from the vent gas vapors. In the examples shown in FIGS. 1, 2 and 3, the control and abatement means is operably connected to each of several underground storage tanks and depending upon the number of pumps in use at one time or the number of tanks being filled at one time, will be operable to control and abate vapor emissions therefrom. For purposes of brevity and clarity, the arrangement of the control and abatement means of this invention with only one tank will be described in detail.

Pressure vacuum valve 44 is normally closed so that gasoline vapors in the underground storage tank 18 will not normally escape through vent pipe 42. Valve 44 may be set at a pressure of +5.7 inches WC so that if the vapor pressure in the underground tank becomes too great during bulk filling of the underground tank with liquid gasoline, the pressure vacuum valve 44 will open to relieve such pressure. Likewise, when liquid gasoline is being withdrawn from the underground storage tank 18, the vacuum side of valve 44 which may be set at −4.6 inches WC will open to admit atmospheric air through the vent pipe to prevent cavitation or collapse of the walls of the storage tank 18. It will thus be apparent that the pressure vacuum valve 44 provides a safety control for the filling and withdrawal of liquid gasoline from the underground storage tank and at the same time normally prevents escape of gasoline vapors to atmosphere.

One of the two stages of the abatement control system of this invention is based upon the condition which involves the filling of an automobile tank from the underground storage tank and with the assumption that the vent lines described above are in leak-tight sealed relation with respect to the automobile tank and also the underground storage tank. In stage one, that is the filling of an automobile tank, the gasoline liquid level in the underground storage tank 18 will be slightly lowered as the liquid is pumped to the automobile tank. At the automobile tank the introduction of additional gasoline liquid to the tank causes displacement of gasoline vapors in the automobile tank which pass through the vent line 22 back to the vapor space in the underground storage tank 18. If the temperature of the liquid gasoline and the degree of hydrocarbon saturation of vapor in the storage tank and the gasoline vapor in the automobile tank were the same, there would be no cause for venting vapors to atmosphere. However, if the vapors from the automobile tank are colder or less saturated than the gasoline and vapors in the storage tank, the cold vapors will expand and will require relief or the pressures will build up in the underground storage tank. If the vapors from the automobile tank are warmer than the gasoline in the storage tank, the vapors upon reaching the storage tank will contract and cause a negative pressure condition within the storage tank unless additional air is provided.

In bulk filling of the underground storage tank from a tank truck, the vapors in the underground storage tank will be displaced through line 33 to be returned to the space in the tank truck above the level 27 of the gasoline in the tank truck. If the gasoline in the truck is colder or less hydrocarbon saturated than the gasoline in the storage tank, then the warm gasoline vapors from the storage tank entering the tank truck will contract and require additional air in the space above the liquid level 27 in the tank truck or a reduction of pressure will occur in the tank truck. In the event the outside temperature and the temperatures in the tank truck are higher than the gasoline vapors coming from the underground storage tank, then pressure in the tank truck will increase as the cooler storage tank vapors are heated and expanded by the warmer truck walls. It will thus be apparent that the effect of the transfer of gasoline vapors from storage tank to delivery truck tank and to automobile tank whether the gasoline storage is hotter or colder, will have opposite effects on the vapor expansion-contraction relationship occuring in the closed vapor system until the truck or automobile tank is disconnected from the system. Simultaneous pumping of gasoline to fill auto tanks while the storage tank is being filled by a tank delivery truck does not provide an additive condition. The pumping rate to automobile tanks at a service station will probably not exceed thirty gallons per minute. An exemplary delivery truck gravity drop rate may be up to 4000 gallons in 10 minutes or about 400 gallons per minute and may be considered as an average fill rate for underground storage tanks under present practice.

Under a stage one condition of the present system, that is relatively low disposal pressure and small vapor volume, gasoline vent vapors in line 46 are controlled by a pressure switch 51 which responds to the vapor pressure and which may be set to make or close at as low a pressure as possible depending upon the negative pressure required to collect the gasoline vapors, such as from about −0.2 inch WC to −0.5 inch WC.

Means for vacuum pumping the gasoline vapors to the incinerator device 45 comprises a suitable pressure air source not shown, capable of supplying air at a preferred pressure in the order of 30 – 100 psi gauge. Such pressure air enters the system at 65 (FIG. 2) through a manual cock valve 66 and through air lines 67 to an air pressure regulator 68. The sensing of a selected pressure by pressure switch 51 causes actuation of solenoid air valve 69 which supplies air at a selected pressure through a continuation of line 67 to an atmospheric mixer 62 and to ejector 62*a*. Mixer 62 may be a Hauck Mfg. Co. high pressure air gas booster BIG 107A (combined mixer and ejector). An air pressure gauge 70 is connected to line 67 and an air pressure switch 71 is aassociated with said gauge and will provide a selected pressure such as 20 psig. Closing of pressure switch 51 permits gasoline vapor which has accumulated in the system and tank 18 to be released by solenoid valve 55 which is actuated by pressure switch 71. Vapors passing through solenoid valve 55 move through a pipe portion 57 of reduced diameter to increase the velocity of the vapor and then through a check valve 58, a flame arrestor 59, a pressure tap device 60, to ejector 62*a* and mixer 62 having a capacity of in this example, of approximately 90,000 btu's per hour. Mixer 62 is associated with a retaining flame type burner nozzle 63. When pressure switch 71 closes, causing solenoid 55 to open which in turn provides the proper flow of gasoline vapors, complete combustion of the gasoline vapors is provided.

The burner 63 will be extinguished when the vapor pressure drops to the level for which pressure switch 73 is set which may be in the order of minus 0.65 inch WC. This pressure level is determined by a selected pressure drop of the system which will prevent appreciable outward leakage of gasoline vapors.

Under bulk filling of the underground storage tank at a rapid rate, the vapor pressure may rapidly increase and may require destruction at a higher rate than that provided for by burner 63. Under such conditions pressure switch 81, which may be set at minus 0.1 inches will actuate air solenoid valve 92 in air line 87 which is joined with the main air feed line 93. A suitable air pressure regulator 94 is provided in air line 87. Pressure switch 81 actuates solenoid valve 92 in line 87 which supplies pressure air to pressure switch 71a which in turn, actuates solenoid valve 82 to release gasoline vapors in line 54. Line 54 may be of greater diameter than line 53 to accommodate passage of a greater volume of gasoline vapors. Solenoid valve 82 admits gasoline vapors to a velocity pipe section 83 of smaller diameter than pipe 54 in order to increase the velocity of the vapors. Gasoline vapors from velocity section 83 may pass through a check valve 84, a flame arrestor 85, a pressure tap and gauge 86 to join with an air line 87 at an ejector 88 which may have a capacity of about 1,000,000 btu's per hour at about 90 psig air pressure and which may be a Hauck BIG 230A (combined mixer and ejector) and to the mixer 89. Mixer 89 feeds the air vapor mixture to a burner 90. When the vent gas pressure is reduced to the level for which pressure switch 95 is set, for example, in the order of −0.3 inches WC, the burners will go out.

Pilot means for igniting burners 63 and 90 may utilize natural gas or a suitable tank supply of propane gas 100 which is fed to a pilot burner 101 through an on-off valve 102, a pressure regulator 103, and a thermopilot relay with pilot gas valve 104. The pilot burner 101 will ignite the air-vapor mixture on either one or the other of the two burning stages of this system. If the pilot burner 101 goes out for any reason because of strong draft, or due to depleted propane supply, the system will become inoperable and the thermopilot will cause deactivation of the entire system as described below with respect to FIG. 3.

The burners 63 and 90 discharge combustion products into a stack pipe means comprising a vertically disposed outer pipe 106 which may be about 8 feet high and 6 inches in diameter, the stack pipe means being of sufficient height and diameter to cause sufficient air to be available to combust all the fumes. The stack pipe means may be located at a service station facility at a minimum distance of at least 25 feet from the gasoline pumps or from relief vents 42 of the tanks. Preferably the stack pipe is installed eight feet above grade. This safety precaution contemplates that if the relief valve 44 opens, gasoline vapors will not flow to adjacent buildings or to the pilot flame at the incinerator means.

It should be noted that burner 63 has an axis aligned with the axis of stack pipe 106 is passed into burner 90, and intersects the arcuate axis of burner 90. The face 63*a* of burner 63 is centrally positioned within burner 90 and below the face 90*a* of burner 90, the upwardly directed portions of burners 63 and 90 being coaxial. Coaxially within stack pipe 106 is a smaller diameter tube 107, about 6 feet in height, 2⅜inches outer diameter, the lower part of the tube being spaced above and from face 90*a* of burner 90 to provide a combustion chamber for the small burner 63. The recessed positioning of face 63*a* of the small burner 63 and the smaller diameter inner tube 107 provides effective operation of the small burner within the structure required for the larger capacity burner. The tube 107 serves to contain the air-gas mixture of burner 63 and inhibits premature cooling of the mixture before combustion is complete.

The stack means provides introduction of air at the bottom of pipe 106 and at openings 108 therein so that sufficient air is added to the air-gas mixture formed in the mixer and burner to substantially completely burn the hydrocarbons in the mixture.

In FIG. 3 a schematic diagram is shown from which operation of the two stage burner system briefly described above will be readily apparent. As shown in FIG. 3, electric power supply may be 115 volt 60 cycles single phase generally indicated at 110 and provided with a ground 111, a fuse 112 and a power on-off switch 113. Connected between the leads of the circuit 114 may be a suitable lamp 115 to indicate that the power for the system is on. The thermopilot relay system 104 may be connected to terminals 104*a* and 104*b* at a junction box. A suitable light 116 is provided to indicate that the pilot is burning normally.

The operation of the burner system shown in FIG. 2 will be further better understood by a consideration of FIG. 3 which is a schematic electrical arrangement for operating the several pressure switches and solenoid valves. In FIG. 3 it should be noted that the square boxes shown merely represent terminals in a remote panel box, and the hexagonal symbols shown represent terminals in a junction box which may be adjacent to the combustion unit. Keeping in mind that the square and hexagonal symbols are terminal points only in the electrical system and having above described the power on and pilot on situation, a lead 120 from terminal 121 connects pressure switch 73 in series with pressure switch 51 through panel terminal 122. Pressure switch 73 may be set at minus 0.65 inch WC and pressure switch 51 set at minus 0.5 inch WC. As displacement pressure in the underground storage tank 18 increases during bulk filling, it will be apparent that pressure switch 73 will be normally closed at pressures above minus 0.65 inch WC and that when the selected disposal pressure of above minus 0.5 inch WC is reached, pressure switch 51 will close and complete a circuit through panel terminal 123 and through junction terminals 124 and 125 of the solenoid valve 69 so that a supply of compressed air regulated at about 50 – 100 psig is furnished to mixer 62*a* and burner 63. In some installations, if there is in sufficient air pressure to draw on such vapors in the system, a larger sized orifice may be used. Such closure of pressure switch 51 also lights a lamp 126 which indicates that disposal pressure is reached.

A control relay 128 with control relay contacts 129 provided between panel terminals 122 and 123 bypasses pressure switch 51. The contacts of controlled relay 128 are normally open and are closed when pressure switches 73 and 51 are closed. The control relay 128 is used to prevent on and off operation of solenoid valve 69 when the pressure is in the range of between minus 0.65 inch WC and minus 0.5 inch WC. The control relay pulls the solenoid valve open until the pressure switch 73 opens and serves to cover the difference in pressure ranges between the two pressure switches. This may also be done by using a single switch with a larger pressure differential.

Disposal air pressure having been reached as above described, air being fed to the burner closes pressure switch 71. Lead 130 is connected at one end to panel terminal 123 and at its other end to panel terminal 131 through pressure switch 71 which upon closing, causes opening of solenoid valve 55 connected between junction terminals 132 and 133. At the same time lamp 134 is turned on to indicate that vapor gases at above the disposal pressures for which the system is set are being fed to the small burner 63.

With the thermopilot relay in "on" condition, the presence of a mixture of vapor gas and air at burner 63 will produce ignition of the mixed air and vapor for virtually complete combustion of the gas vapors.

In some filling conditions when disposal pressures increase rapidly, such that the small burner and ejector are not sufficient to lower the pressure, a burner unit of larger capacity is required. With the thermopilot relay in on condition, a lead 140 is connected to panel terminal 121 and to one side of pressure switch 95 connected to panel terminal 141 and to pressure switch 81. When the second selected disposal pressure of vapor gases is reached, the pressure switch 95 which may be set at minus 0.5 inches WC and the pressure switch 81 which may be set at minus 0.1 inches WC will both be closed and provide a circuit through panel terminal 142 to solenoid valve 92 for supplying compressed air to ejector 88.

As in the above description, a control relay 143 is provided a pair of normally open controlled relay contacts 194 which are connected to the panel terminal 141 so that in the pressure range of between minus 0.5 inch WC and minus 0.1 inch WC on and off operation of the solenoid valve will be prevented. From panel board terminal 142 a lead 147 is connected to pressure switch 85 which when closed is connected through panel terminal 148 to junction terminal 149 and 150 for opening actuation of the solenoid valve 82 for causing vapor gases to flow to the burner 89. A lamp 152 is lighted under such conditions and indicates that burner 90 is on.

It should be noted that burner unit 63 within burner unit 90 usually will be burning at the same time as unit 90 into the stack pipe 106 and will continue to burn as long as the vapor pressures exceed the amount set for pressure switches 51 and 81. When the vapor pressures in the vent system drop to the pressure levels at which pressure switches 73 and 95 are set, it will be apparent that opening of switches 73 and/or 95 will open the circuit to the respective solenoid valves 69 and 92 as well as the vapor gas solenoid valves 55 and 82 so that the burners 63 and 90 will go out.

It will be apparent that the pressure switches and solenoid valves are inoperable unless the thermopilot switch 104 is in closed condition and the pilot is in operation condition. Opening of the thermopilot switch 104 de-energizes the entire electrical system.

It should be noted that in operation of the above described system and with the use of the control relays to prevent "on-off" operation and to maintain an on condition until the pressure switches 73 and 95 reach their pressure setting, that no vent gases escape to atmosphere and that the system is immediately responsive to variations in gas vapor pressure in the vent pipes resulting from changes in the condition of the vapors in the underground storage tank 18.

In the present example, the burner units 63 and 90 have been exemplarily indicated as being capable of burning approximately 90,000 btu per hour and approximately 1,000,000 btu per hour respectively. The selected btu capacity of the burner units and the negative pressure setting of the pressure switches may be somewhat varied depending upon the geographical location of the service station, particularly with respect to altitude, the type of gasoline, (ethyl or regular) being stored in the storage tanks, and the ambient temperature of the locality of the service station, particularly seasonal changes. The Reid vapor pressure of gasoline to be delivered to a service station may vary, higher in winter, lower in summer, and lower in high altitudes. Each station may differ somewhat in the various selected settings of the vapor destructor system. An example of the Btu content of gasoline with a Reid vapor pressure of 11 psia at 60° Fahrenheit is given in the below chart.

| | Volume % | Btu's per cu. ft. | Basis = 100 cu. ft. |
|---|---|---|---|
| Ethane | 0.06 | 1,775 | 107 |
| Propane | 1.05 | 2,526 | 2,650 |
| Iso Propane | 5.75 | 3,268 | 18,800 |
| N Butane | 12.95 | 3,276 | 42,500 |
| Butene | 0.54 | 3,124 | 1,690 |
| Iso Pentane | 8.05 | 4,012 | 32,400 |
| N Pentane | 4.02 | 4,025 | 16,200 |
| Heavy Hexane | 4.78 | 4,773 | 22,800 |
| Air | 62.8 | | |
| | | | 137,147 = 1,371 btu's per cu. ft. with air mixed in |

The Btu value of the gasoline vapors on an air-free basis is approximately 3,600 Btu per cubic foot.

It is apparent to those skilled in the art that at different service stations, different conditions must be taken into consideration in order to determine the proper pressure settings for the pressure sensing switches and the burning capacity of the two burners so that excess vapor pressure may be adequately handled. Such different conditions include the number of gallons of gasoline delivered to underground storage tanks, the number of deliveries at any one time, the temperature of the gasoline in the delivery tank truck, the number of minutes allowed for the transfer of the liquid gasoline from one tank to the other tank, the maximum amount of excess vapor volume which might be expected, such as 1–10 percent of the gasoline volume dropped, and the Btu value of the gas. For example, it is contemplated that the vapor air mixture supplied at the burners will be approximately 40 percent gas vapor. Atmospheric air entering at the stack may comprise 60 percent which, at the Btu content of the air-free gasoline vapors, provides a suitable mixture for achieving virtually complete combustion of the gasoline vented vapors with combustion chambers properly designed for that installation.

The determination of pressure settings includes consideration of the fact that operation at lower pressure will consume more fumes and incur greater operating costs. If insufficient negative pressure is present, excessive leaks will occur at the delivery nozzle 12 and the selected system of pressure differentials will not operate as intended. If the pressure differential range is set too close, which is undesirable, operation of the burners will be too frequent and therefore cause more wear and tear on the system and increase maintenance costs. Thus for each installation, depending upon the various conditions there existing, the pressure sensing switches may be set at a differential range to provide optimum operation for that installation.

It will thus be understood by those skilled in the art that the method and apparatus of the present invention is readily adapted to variable operating conditions, is effective in the reduction of air pollution from this source, is relatively inexpensive to install and maintain, and is virtually automatic in operating. The piping arrangement of the vent lines assures that gas vapors from a transfer operation pass through the vapor space from one end of the storage tank to the other end of the tank before the vapors are vented and burned.

It will be apparent from the above description that a method and a system has been provided for the virtually complete destruction of unwanted hydrocarbons in the disposition of gasoline vapors emitted at a gasoline service station facility. While the described example of the invention relates to vapors from gasoline, the method of the invention may be practiced with other volatile liquids to dispose of off gases which may go above the upper explosive limit of that gas. Use of the term "gasoline" includes such other liquids.

All modifications and changes coming within the scope of the appended claims are embraced thereby.

I claim:

1. In a method of abating emissions of gasoline vapors at a gasoline service station at which liquid gasoline is transferred between a storage tank and a supply tank by flowing through a liquid gas line means having vapor tight sealed connections with said tanks; the steps of:

providing gasoline vapor line means between said tanks for communication between vapor space above liquid levels in said tanks;

providing a gas vapor vent line from vapor space in said storage tank to a burner means;

passing gasoline vapors from said supply tank into and through said vapor space in said storage tank;

sensing vapor pressure at said vent line means;

causing gasoline vapors in said vent line means to be directed to the burner means when a preselected vapor pressure is sensed;

and igniting and burning said gasoline vapors at said burner means.

2. In a method as stated in claim 1 wherein the step of sensing vapor pressure at said vent line means includes sensing a selected vapor pressure for one type of transfer of liquid gasoline at said service station;

and burning the gasoline vapors at a selected first burner.

3. In a method as stated in claim 2 including the step of:

sensing a selected vapor pressure for another type of transfer of liquid gasoline at said service station;

and burning the gasoline vapors at a different second burner means.

4. In a method as stated in claim 3 including the step of:

combining the first and second burner means for burning gasoline vapors at one stack pipe means, one of said burner means extending into the other burner means, both of said burner means having discharge parts coaxial with said stack pipe.

5. In a method as stated in claim 1 wherein the step of igniting and burning the gasoline vapors includes intermittently igniting and burning said vapors depending upon the vapor pressure sensed in the vapor vent line.

6. In a method as stated in claim 1 wherein the step of causing vapors in said vent line to be directed to the burner means includes simultaneously causing air to be supplied to said burner means to provide substantially complete combustion of the vapor air mixture at said burner means.

7. In a method of abatement of vapor gases emitted from storage containers during transfer of fluids including liquids and gases to or from the containers, said fluids in said storage containers being subject to changes in pressure, temperature, and volume, at least one of said storage containers having a vent means to atmosphere; including the steps of:

sensing the pressure of said gases in said vent means;

causing the gases in said vent means to be directed along a path to an incinerator means at a preselected below atmospheric pressure;

causing combustion air to be directed to said incinerator means when said preselected pressure is sensed for mixing with said gas to provide virtually complete combustion;

and igniting and burning said mixture at said incinerator means.

8. In a method as stated in claim 7 wherein the step of causing the gases in the vent means to be directed to the incinerator means at a preselected pressure includes selecting a pressure differential range including below atmospheric pressure in said vent means.

9. In a method as stated in claim 7 including the step of:

placing all gases in communication with the storage container having the vent means.

10. In a method as stated in claim 7 wherein the step of igniting and burning said mixture includes intermittent igniting and burning of the mixture depending upon the sensed pressure of said gases in said vent means.

11. In an apparatus for abatement of gasoline vapor emissions from a vent pipe of a liquid gasoline storage tank in which gasoline vapors in the storage tank become saturated, the storage tank having a vent pipe to atmosphere and in communication with said vapor, the provision of:

means for sensing vapor gas pressure in said vent pipe;

a burner means;

and means placing said burner means in communication with said vent pipe under preselected pressure conditons of said vapor at said vent pipe;

and means for igniting said burner means.

12. In an apparatus at stated in claim 11 wherein said means placing said burner means in communication with said vent pipe includes a communication line having a normally closed solenoid valve means, and a pressure responsive switch means in said communication line to actuate said solenoid valve means in response to a selected vent gas pressure.

13. In an apparatus as stated in claim 11 including ejector means operable in response to said sensing means for vacuum pumping said vapors to said burner means and for causing a preselected amount of air to mix with said vapors to provide practically complete combustion thereof at said burner means.

14. In an apparatus as stated in claim 11 including a vapor tight vent line between said storage tank and a supply tank, said vent line being connected to said storage tank at a location remote from said vent pipe whereby all vapors are passed from said storage tank to said vent pipe.

15. In an apparatus as stated in claim 11 wherein said means for sensing vapor pressure and vacuum in said vent pipe includes a preselected pressure differential range;

said igniting means for said burner means said burner means being ignited upon sensing of pressures within said pressure differential range.

16. In an apparatus as stated in claim 13 wherein said ejector means includes a first ejector of a selected capacity and a second ejector of different capacity than the first ejector, said burner means includes a burner member associated with each ejector, said burner members having burner portions coaxially arranged for selective simultaneous or independent burning into a common coaxialy disposed stack means.

17. In an apparatus as stated in claim 16 including a stack means having outer and inner stack pipes cooperable with either or both burner members during burning.

18. In an apparatus normally operable at below atmospheric pressure for abatement of gasoline vapor emissions from a vent pipe of a liquid gasoline storage tank, in which gasoline vapors in the storage tank become saturated, the storage tank having a vent pipe to atmosphere and in communication with said vapor, the provision of:

a vapor gas pressure switch means at said vent pipe for sensing vapor gas pressure in said vent pipe;

a compressed air source;

an ejector means in communication with said compressed air source;

a burner means in communication with said ejector means;

means for directing vapor gas from said vent pipe to said burner means at selected vapor pressures;

said ejector means, said burner means, and said directing means being operable in response to said vapor gas pressure switch means to cause said vapor gas to flow to said burner means and to be mixed with a selected amount of air from said air source to provide substantially complete combustion;

and means for igniting said burner means.

19. In an apparatus as stated in claim 18 wherein said means for directing vapor gas from said vent pipe to said burner means at selected vapor pressure includes a vapor conducting line from said vent pipe to said ejector means;

a valve means in said vapor conducting line;

an air line from said air source to said ejector means;

an air pressure switch means in said air line;

said valve means being actuated by said pressure switch means in response to actuation of said vapor gas pressure switch means.

* * * * *